US007775734B2

(12) United States Patent
Dylkiewicz et al.

(10) Patent No.: US 7,775,734 B2
(45) **Date of Patent: *Aug. 17, 2010**

(54) SEAL ASSEMBLY FOR RETRACTABLE INSTRUMENT

(75) Inventors: David A. Dylkiewicz, Lockport, IL (US); Robert G. Challman, Naperville, IL (US)

(73) Assignee: Sanford L.P., Oak Brook, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/368,066

(22) Filed: Feb. 9, 2009

(65) Prior Publication Data

US 2009/0142124 A1 Jun. 4, 2009

Related U.S. Application Data

(63) Continuation of application No. 11/701,231, filed on Feb. 1, 2007, now Pat. No. 7,488,130.

(51) Int. Cl.
*B43K 7/12* (2006.01)

(52) U.S. Cl. ..... 401/108

(58) Field of Classification Search ..... 401/59–61, 401/99, 102, 107, 108, 213, 202
See application file for complete search history.

(56) References Cited

U.S. PATENT DOCUMENTS

| | | | |
|---|---|---|---|
| 1,810,249 | A | 6/1931 | Koehler |
| 1,940,548 | A | 12/1933 | Jensen |
| 2,291,859 | A | 8/1942 | Andrews |
| 2,392,840 | A | 1/1946 | Groft |
| 2,401,711 | A | 6/1946 | Smith |
| 2,603,186 | A | 7/1952 | Fischer |
| 2,626,049 | A | 1/1953 | Tursky |
| 2,874,679 | A | 2/1959 | Zepelovitch |
| 2,949,887 | A | 8/1960 | Martin et al. |

(Continued)

FOREIGN PATENT DOCUMENTS

| | | |
|---|---|---|
| DE | 451 884 | 11/1927 |

(Continued)

OTHER PUBLICATIONS

Avery Office Products, "Retractable Whiteboard Markers," Avery Dennison Corporation (1996-2008), Retrieved from the Internet on Jun. 19, 2008: URL:<http://www.avery.com/us/Main?action=product.HierarchyList&node=10211090&catalogcode=WEB01.

(Continued)

*Primary Examiner*—Huyen Le
(74) *Attorney, Agent, or Firm*—Marshall, Gerstein & Borun LLP

(57) ABSTRACT

A closure assembly for a retractable instrument having an applicator element comprises at least two fingers and a sleeve operatively coupled with the at least two fingers. When the retractable instrument is in a retracted position, the sleeve constrains the fingers such that the fingers are in a fully closed state around the applicator element. Protraction of the sleeve and relative movement between the fingers and the sleeve allows the fingers to open, thereby exposing the applicator element. Thus, the closure assembly opens to expose an applicator element such that the applicator element is in an application position.

20 Claims, 7 Drawing Sheets

U.S. PATENT DOCUMENTS

| | | | | |
|---|---|---|---|---|
| 2,957,452 | A | | 10/1960 | Brannon |
| 3,035,299 | A | | 5/1962 | Gordon et al. |
| 3,124,106 | A | | 3/1964 | Kosta |
| 3,146,758 | A | | 9/1964 | Zepell |
| 3,169,511 | A | | 2/1965 | Spatz |
| 3,480,370 | A | | 11/1969 | Koeln |
| 3,525,573 | A | * | 8/1970 | Fend ..... 401/108 |
| 3,583,820 | A | | 6/1971 | Koeln |
| 3,594,091 | A | | 7/1971 | Bleuer |
| 3,617,138 | A | | 11/1971 | Fukui et al. |
| 3,637,316 | A | | 1/1972 | Bross et al. |
| 3,733,139 | A | | 5/1973 | Neidhardt et al. |
| 3,813,176 | A | | 5/1974 | Kamo |
| 3,895,632 | A | | 7/1975 | Plowiecki et al. |
| 3,941,488 | A | | 3/1976 | Maxwell |
| 3,944,371 | A | | 3/1976 | Schenk |
| 3,945,734 | A | | 3/1976 | Woodbridge |
| 3,955,893 | A | | 5/1976 | Pulaski |
| 3,985,455 | A | | 10/1976 | Wahlberg |
| 4,022,535 | A | | 5/1977 | Ritter |
| 4,115,015 | A | | 9/1978 | Torii et al. |
| 4,161,374 | A | | 7/1979 | Koeln et al. |
| 4,177,814 | A | | 12/1979 | Knepshield et al. |
| 4,218,154 | A | | 8/1980 | Erfer |
| 4,221,490 | A | | 9/1980 | Malm |
| 4,269,525 | A | | 5/1981 | Melikian |
| 4,315,695 | A | | 2/1982 | Alves dos Santos et al. |
| 4,318,340 | A | | 3/1982 | Shenoha et al. |
| 4,459,056 | A | | 7/1984 | Getgey et al. |
| 4,469,462 | A | | 9/1984 | Hashimoto et al. |
| 4,479,732 | A | | 10/1984 | Shimizu et al. |
| 4,533,271 | A | | 8/1985 | Sansevero |
| 4,540,300 | A | * | 9/1985 | Midorikawa ..... 401/107 |
| 4,549,827 | A | | 10/1985 | Mack |
| 4,560,297 | A | | 12/1985 | Leem et al. |
| 4,575,271 | A | | 3/1986 | Hashimoto et al. |
| 4,580,918 | A | | 4/1986 | Baker et al. |
| 4,618,280 | A | | 10/1986 | Kageyama et al. |
| 4,629,348 | A | | 12/1986 | Hashimoto et al. |
| 4,711,592 | A | | 12/1987 | Gregory |
| 4,738,724 | A | | 4/1988 | Wittwer et al. |
| 4,738,817 | A | | 4/1988 | Wittwer et al. |
| 4,759,650 | A | | 7/1988 | Granoff |
| 4,768,529 | A | | 9/1988 | Mahruki et al. |
| 4,812,299 | A | | 3/1989 | Wason |
| 4,815,881 | A | | 3/1989 | Chern |
| 4,859,103 | A | | 8/1989 | Wittek et al. |
| 4,863,796 | A | | 9/1989 | Wason |
| 4,879,058 | A | | 11/1989 | Wason |
| 4,879,323 | A | | 11/1989 | Wason |
| 4,896,983 | A | | 1/1990 | Im et al. |
| 4,902,657 | A | | 2/1990 | Wason |
| 4,902,729 | A | | 2/1990 | Wason |
| 4,904,101 | A | | 2/1990 | Petterson |
| 4,911,570 | A | | 3/1990 | Rhoades |
| 4,933,387 | A | | 6/1990 | Wason |
| 4,937,078 | A | | 6/1990 | Mezei et al. |
| 4,954,468 | A | | 9/1990 | Wason |
| 4,968,728 | A | | 11/1990 | Wason |
| 4,969,764 | A | * | 11/1990 | Gregory ..... 401/108 |
| 4,974,980 | A | | 12/1990 | Gueret et al. |
| 5,015,111 | A | | 5/1991 | Petterson |
| 5,022,773 | A | | 6/1991 | Waldinger et al. |
| 5,026,189 | A | | 6/1991 | Keil et al. |
| 5,048,990 | A | | 9/1991 | Hashimoto et al. |
| 5,090,955 | A | | 2/1992 | Simon |
| D324,542 | S | | 3/1992 | Lin |
| 5,092,701 | A | | 3/1992 | Lai et al. |
| 5,174,814 | A | | 12/1992 | Burwell et al. |
| 5,184,908 | A | | 2/1993 | Yamamoto et al. |
| 5,207,523 | A | | 5/1993 | Wittek |
| 5,336,006 | A | | 8/1994 | Badr et al. |
| 5,342,135 | A | | 8/1994 | Tucker |
| 5,342,136 | A | | 8/1994 | Fukami et al. |
| 5,358,864 | A | | 10/1994 | van den Broeck et al. |
| 5,372,580 | A | | 12/1994 | Simon et al. |
| 5,420,615 | A | | 5/1995 | Witz et al. |
| 5,426,456 | A | | 6/1995 | Kuelzer et al. |
| 5,439,626 | A | | 8/1995 | Bennett et al. |
| 5,454,655 | A | | 10/1995 | Chiswell |
| 5,517,218 | A | | 5/1996 | Lehna et al. |
| 5,547,301 | A | | 8/1996 | Kageyama et al. |
| 5,547,468 | A | | 8/1996 | Simon et al. |
| 5,553,956 | A | | 9/1996 | Mitsuya et al. |
| 5,599,122 | A | | 2/1997 | Yu |
| 5,604,036 | A | | 2/1997 | Price et al. |
| 5,605,402 | A | | 2/1997 | Uggetti et al. |
| 5,607,437 | A | | 3/1997 | Simon et al. |
| 5,610,046 | A | | 3/1997 | van Ooyen et al. |
| 5,643,660 | A | | 7/1997 | Price et al. |
| 5,651,627 | A | | 7/1997 | Dowzall et al. |
| 5,653,725 | A | | 8/1997 | Simon et al. |
| 5,672,021 | A | | 9/1997 | Abber et al. |
| 5,676,481 | A | | 10/1997 | Nicoll et al. |
| 5,813,787 | A | | 9/1998 | Dowzall et al. |
| 5,823,697 | A | | 10/1998 | Talbot et al. |
| D400,581 | S | | 11/1998 | Hasegawa |
| 5,829,904 | A | | 11/1998 | Matsumoto et al. |
| 5,849,559 | A | | 12/1998 | Van Der Wouw et al. |
| 5,855,442 | A | | 1/1999 | Keller |
| 5,865,553 | A | | 2/1999 | Flye Sainte Marie et al. |
| 5,871,294 | A | | 2/1999 | Turner |
| 5,871,296 | A | | 2/1999 | Furukawa et al. |
| 5,891,398 | A | | 4/1999 | Lewis et al. |
| 5,899,618 | A | | 5/1999 | Kobayashi et al. |
| 5,906,446 | A | | 5/1999 | McCulloch et al. |
| 5,915,867 | A | | 6/1999 | Hashimoto et al. |
| 5,927,881 | A | | 7/1999 | Yang |
| 5,927,882 | A | | 7/1999 | Kageyama et al. |
| 5,927,883 | A | | 7/1999 | Lebauer |
| 5,929,051 | A | | 7/1999 | Ni et al. |
| 5,931,846 | A | | 8/1999 | Simon et al. |
| 5,947,624 | A | | 9/1999 | Davignon |
| 5,957,603 | A | | 9/1999 | Bell |
| 5,961,703 | A | | 10/1999 | Fraas et al. |
| 5,967,688 | A | | 10/1999 | Hu et al. |
| D417,206 | S | | 11/1999 | Hirota |
| 6,019,535 | A | | 2/2000 | Turner |
| 6,027,271 | A | | 2/2000 | Barosso et al. |
| 6,033,141 | A | | 3/2000 | Blaustein et al. |
| 6,048,121 | A | | 4/2000 | Carver |
| 6,066,356 | A | | 5/2000 | Van Der Wouw et al. |
| 6,089,776 | A | | 7/2000 | Kaufmann et al. |
| 6,095,707 | A | | 8/2000 | Kaufmann et al. |
| 6,099,924 | A | | 8/2000 | Nakamaki et al. |
| 6,106,179 | A | | 8/2000 | Kuo |
| 6,120,204 | A | | 9/2000 | Rigoni |
| 6,120,751 | A | | 9/2000 | Unger |
| 6,135,660 | A | | 10/2000 | Stevens et al. |
| 6,155,733 | A | | 12/2000 | Holbrook et al. |
| 6,158,913 | A | | 12/2000 | Dumler et al. |
| 6,170,318 | B1 | | 1/2001 | Lewis |
| 6,213,661 | B1 | | 4/2001 | Coon |
| 6,231,257 | B1 | | 5/2001 | Stevens et al. |
| 6,244,744 | B1 | | 6/2001 | Calvin |
| 6,244,774 | B1 | | 6/2001 | Barosso et al. |
| 6,261,019 | B1 | | 7/2001 | Furukawa et al. |
| D446,213 | S | | 8/2001 | Chen et al. |
| 6,306,598 | B1 | | 10/2001 | Charych et al. |
| 6,347,898 | B1 | | 2/2002 | Rhodes et al. |
| 6,350,369 | B1 | | 2/2002 | Lewis et al. |
| 6,371,673 | B1 | | 4/2002 | Gueret |
| D457,185 | S | | 5/2002 | Ham |
| 6,409,408 | B2 | | 6/2002 | Koyama et al. |

D460,484 S 7/2002 Bianco, Jr.
D460,982 S 7/2002 Bianco, Jr.
6,416,242 B1 7/2002 Kaufmann et al.
6,417,121 B1 7/2002 Newkirk et al.
6,417,122 B1 7/2002 Newkirk et al.
6,420,285 B1 7/2002 Newkirk et al.
6,433,012 B1 8/2002 Tuse et al.
6,468,759 B1 10/2002 Charych
6,478,495 B2 11/2002 Ami et al.
6,482,517 B1 11/2002 Anderson
6,505,984 B2 1/2003 Smith et al.
D471,233 S 3/2003 Geiselhart et al.
D472,578 S 4/2003 Plantz et al.
6,540,422 B2 4/2003 Torii
6,554,516 B1 4/2003 Christopher
6,554,517 B2 4/2003 Ahmed
6,561,713 B2 5/2003 Sukhna et al.
6,565,275 B2 5/2003 Brand et al.
6,565,763 B1 5/2003 Asakawa et al.
6,588,958 B1 7/2003 Seidler
6,605,344 B1 8/2003 Ohba et al.
6,607,325 B2 8/2003 Hori et al.
6,631,333 B1 10/2003 Lewis et al.
6,638,621 B2 10/2003 Anderson
6,644,880 B2 11/2003 Duez et al.
6,648,539 B2 11/2003 Dai et al.
6,656,319 B1 12/2003 Boyd et al.
D487,113 S 2/2004 Kent
D489,087 S 4/2004 Kent
6,723,394 B1 4/2004 Sirringhaus et al.
6,752,557 B1 6/2004 Hsieh et al.
6,755,584 B2 6/2004 O'Brien et al.
D497,180 S 10/2004 Cetera
D497,387 S 10/2004 Cetera
D501,509 S 2/2005 Lecce
6,927,256 B2 8/2005 Stevens et al.
6,964,534 B2 11/2005 Brand et al.
6,967,102 B1 11/2005 Anderson et al.
6,974,697 B2 12/2005 Comer et al.
6,977,244 B2 12/2005 Tormo et al.
6,979,456 B1 12/2005 Parikh et al.
6,979,558 B2 12/2005 Harris, Jr. et al.
6,979,559 B2 12/2005 Harris, Jr. et al.
6,981,812 B1 1/2006 Hsieh et al.
6,989,007 B2 1/2006 Shadduck
6,989,195 B2 1/2006 Anderson
6,991,514 B1 1/2006 Meloni et al.
7,004,945 B2 2/2006 Boyd et al.
7,008,633 B2 3/2006 Yang et al.
7,018,838 B2 3/2006 Murphy et al.
7,022,683 B1 4/2006 Ni et al.
7,037,015 B1 5/2006 Witz et al.
7,037,657 B2 5/2006 Le et al.
7,048,963 B2 5/2006 Braithwaite et al.
7,059,796 B2 6/2006 Lewis, Jr. et al.
7,060,754 B2 6/2006 Stevens et al.
7,101,102 B2 9/2006 Sawa et al.
7,329,062 B2 2/2008 Brand et al.
7,350,996 B2 4/2008 Bielecki et al.
7,488,130 B2 * 2/2009 Dylkiewicz et al. ..... 401/108
2002/0010510 A1 1/2002 Silvestrini
2002/0029084 A1 3/2002 Paul et al.
2002/0081139 A1 6/2002 Legg
2002/0081232 A1 6/2002 Lewis et al.
2002/0131807 A1 9/2002 Ami et al.
2002/0142477 A1 10/2002 Lewis et al.
2002/0159817 A1 10/2002 Brand et al.
2002/0159818 A1 10/2002 Smith et al.
2002/0172544 A1 11/2002 Dai
2002/0192007 A1 12/2002 Lee
2003/0068191 A1 4/2003 Hori
2003/0108377 A1 6/2003 Duez et al.
2003/0108743 A1 6/2003 Anderson
2003/0138283 A1 7/2003 O'Brien et al.
2003/0195300 A1 10/2003 Stevens et al.
2003/0210945 A1 11/2003 Noguchi
2003/0210947 A1 11/2003 calendrille et al.
2003/0211130 A1 11/2003 Sanders et al.
2003/0215281 A1 11/2003 Sexton et al.
2003/0222048 A1 12/2003 Asakawa et al.
2004/0028875 A1 2/2004 Van Rijn et al.
2004/0037609 A1 2/2004 Kageyama
2004/0050816 A1 3/2004 Asakawa et al.
2004/0062879 A1 4/2004 Bowman et al.
2004/0201117 A1 10/2004 Anderson
2004/0213627 A1 10/2004 Marschand et al.
2004/0265035 A1 12/2004 Brand et al.
2004/0265039 A1 12/2004 Buck
2005/0004578 A1 1/2005 Lambrecht et al.
2005/0019112 A1 1/2005 Erickson et al.
2005/0043470 A1 2/2005 Stevens et al.
2005/0047844 A1 3/2005 Lammers et al.
2005/0074268 A1 4/2005 Beil
2005/0079003 A1 4/2005 Buck et al.
2005/0084320 A1 4/2005 Carroll
2005/0084321 A1 4/2005 Carroll
2005/0089656 A1 4/2005 Shiina
2005/0115690 A1 6/2005 Bohlig
2005/0191112 A1 9/2005 Yoon
2005/0196580 A1 9/2005 Provost et al.
2005/0196583 A1 9/2005 Provost et al.
2005/0208259 A1 9/2005 Provost et al.
2005/0217092 A1 10/2005 Barker et al.
2005/0221271 A1 10/2005 Murphy et al.
2005/0246023 A1 11/2005 Yeung
2005/0250181 A1 11/2005 Schroder Glad et al.
2005/0256253 A1 11/2005 Parker et al.
2005/0265774 A1 12/2005 Albisetti
2005/0271451 A1 12/2005 Brand et al.
2006/0002755 A1 1/2006 Sawa
2006/0002852 A1 1/2006 Saltzman et al.
2006/0002971 A1 1/2006 Saltzman et al.
2006/0004193 A1 1/2006 Muller et al.
2006/0004314 A1 1/2006 McCarthy et al.
2006/0019339 A1 1/2006 Lauth et al.
2006/0036269 A1 2/2006 Schachar et al.
2006/0051274 A1 3/2006 Wright et al.
2006/0051451 A1 3/2006 Hutchinson et al.
2006/0051735 A1 3/2006 Fuhr et al.
2006/0058383 A1 3/2006 Huang et al.
2006/0062780 A1 3/2006 Zocher et al.
2006/0063882 A1 3/2006 Velev et al.
2006/0065992 A1 3/2006 Hutchinson et al.
2006/0069230 A1 3/2006 Papisov
2006/0073159 A1 4/2006 Vonderheide et al.
2006/0073294 A1 4/2006 Hutchinson et al.
2006/0073298 A1 4/2006 Hutchinson et al.
2006/0073333 A1 4/2006 Anderson
2006/0084034 A1 4/2006 Hochman
2006/0088897 A1 4/2006 Lim et al.
2006/0095066 A1 5/2006 Chang et al.
2006/0099244 A1 5/2006 Guilford
2006/0106408 A1 5/2006 Schachar et al.
2006/0106409 A1 5/2006 Schachar et al.
2006/0110439 A1 5/2006 Tobia et al.
2006/0115462 A1 6/2006 Subbotin et al.
2006/0116712 A1 6/2006 Sepetka et al.
2006/0116713 A1 6/2006 Sepetka et al.
2006/0121608 A1 6/2006 Comer et al.
2006/0216103 A1 9/2006 Bielecki et al.

FOREIGN PATENT DOCUMENTS

DE 623 816 12/1935
DE 1 259 732 1/1968
DE 26 49 230 4/1978

| | | | |
|---|---|---|---|
| DE | 34 38 074 | | 4/1986 |
| DE | 88 05 298 | | 8/1989 |
| DE | 88 06 917 | U1 | 11/1989 |
| DE | 89 00 030 | U | 5/1990 |
| DE | 295 10 975 | | 9/1995 |
| DE | 33 41 759 | A1 | 11/1997 |
| DE | 297 09 080 | U1 | 10/1998 |
| DE | 100 30 440 | A1 | 1/2002 |
| DE | 103 26 926 | A1 | 1/2005 |
| EP | 0 150 557 | | 8/1985 |
| EP | 0 267 557 | | 5/1988 |
| EP | 0 316 007 | | 5/1989 |
| EP | 0 354 823 | | 2/1990 |
| EP | 0 400 272 | | 12/1990 |
| EP | 0 416 181 | A1 | 3/1991 |
| EP | 0 469 465 | | 2/1992 |
| EP | 0 545 917 | | 6/1993 |
| EP | 0 586 792 | | 3/1994 |
| EP | 0 667 818 | | 8/1995 |
| EP | 0 703 096 | | 3/1996 |
| EP | 0 711 673 | | 5/1996 |
| EP | 0 822 098 | | 2/1998 |
| EP | 0 899 128 | | 3/1999 |
| EP | 1 050 417 | | 11/2000 |
| EP | 1 354 722 | A2 | 10/2003 |
| EP | 1 600 078 | | 11/2005 |
| FR | 1.424.492 | | 1/1966 |
| FR | 2.220.353 | | 10/1974 |
| FR | 2907371 | | 4/2008 |
| GB | 243110 | | 11/1925 |
| GB | 937632 | | 9/1963 |
| GB | 2 106 044 | | 4/1983 |
| GB | 2 325 649 | A | 12/1998 |
| JP | 58-009788 | | 1/1983 |
| JP | 58-153081 | | 9/1983 |
| JP | 60-119588 | | 6/1985 |
| JP | 1-280596 | | 11/1989 |
| JP | 1-281999 | | 11/1989 |
| JP | 2-041992 | | 3/1990 |
| JP | 2-108086 | | 4/1990 |
| JP | 2-283499 | | 11/1990 |
| JP | 4-043345 | | 2/1992 |
| JP | 4-316899 | | 11/1992 |
| JP | 6-035232 | | 2/1994 |
| JP | 6-216585 | | 8/1994 |
| JP | 7-242094 | | 9/1995 |
| JP | 7-290883 | | 11/1995 |
| JP | 7-329486 | | 12/1995 |
| JP | 8-072470 | | 3/1996 |
| JP | 8-108676 | | 4/1996 |
| JP | 8-216585 | | 8/1996 |
| JP | 8-258480 | | 10/1996 |
| JP | 8-282174 | | 10/1996 |
| JP | 8-282175 | | 10/1996 |
| JP | 9-131994 | | 5/1997 |
| JP | 10-100579 | | 4/1998 |
| JP | 10-114188 | | 5/1998 |
| JP | 11-139081 | A | 5/1999 |
| JP | 2000-025386 | A | 1/2000 |
| JP | 2003-128971 | | 5/2003 |
| JP | 2003-312185 | A | 11/2003 |
| JP | 2003-312186 | A | 11/2003 |
| JP | 2003-312188 | A | 11/2003 |
| KP | 2003-056790 | A | 7/2003 |
| KP | 2003-060260 | A | 7/2003 |
| KP | 2003-061516 | A | 7/2003 |
| WO | WO-90/00118 | | 1/1990 |
| WO | WO-93/12175 | | 6/1993 |
| WO | WO-93/17879 | | 9/1993 |
| WO | WO-94/11204 | | 5/1994 |
| WO | WO-94/11205 | | 5/1994 |
| WO | WO-94/25293 | | 11/1994 |
| WO | WO-95/07191 | | 3/1995 |
| WO | WO-96/39054 | | 12/1996 |
| WO | WO-98/06450 | | 2/1998 |
| WO | WO-99/11471 | | 3/1999 |
| WO | WO-01/28696 | | 4/2001 |
| WO | WO-01/64453 | | 9/2001 |
| WO | WO-02/06437 | | 1/2002 |
| WO | WO-02/13173 | | 2/2002 |
| WO | WO-02/064379 | | 8/2002 |
| WO | WO-03/002357 | A1 | 1/2003 |
| WO | WO-03/068530 | | 8/2003 |
| WO | WO-2005/009755 | | 2/2005 |
| WO | WO-2007/097602 | | 8/2007 |
| WO | WO-2007/126253 | | 11/2007 |
| WO | WO-2008/029993 | | 3/2008 |

OTHER PUBLICATIONS

Photograph A, Boone Marker, capped.
Photograph B, Boone Marker, uncapped.
Photograph C, Colorific Retractable Marker, retracted.
Photograph D, Colorific Retractable Marker, extended.
Photograph E, Marks-A-Lot Retractable Marker, retracted.
Photograph F, Marks-A-Lot Retractable Marker, extended.
Photograph G, Sharpie RT Marker, retracted.
Photograph H, Sharpie RT Marker, extended.
Photograph I, Tokai Retractable Marker, retracted.
Photograph J, Tokai Retractable Marker, extended.
English-language translation of DE-8900030U (Berendsohn AG).
English-language translation of WO-9000118A1 (Baird).
International Search Report for Application No. PCT/US2006/011014, dated Nov. 23, 2006.

* cited by examiner

SEAL ASSEMBLY FOR RETRACTABLE INSTRUMENT

CROSS-REFERENCE TO RELATED APPLICATION

This is a continuation of U.S. application Ser. No. 11/701,231, filed Feb. 1, 2007, the entire contents of which are hereby incorporated herein by reference.

TECHNICAL FIELD

The present disclosure relates generally to seal assemblies for instruments, and, more particularly, to a seal assembly for a retractable instrument, such as a retractable marker.

DESCRIPTION OF RELATED TECHNOLOGY

Capless instruments, such as capless retractable markers, have been developed to solve problems and inconveniences associated with retractable instruments having an outer cap. Such inconveniences include having to use two hands "to uncap and cap a marker pen with the outer cap" and easily losing the outer cap when capping or uncapping an applicator element, e.g., a writing tip. See, e.g., U.S. Pat. No. 6,981,812 to (the '812 patent) (providing a description of problems associated with prior art writing instruments using caps). One capless retractable instrument involves hiding a cover of the capless retractable marker pen within a pen tube, and controlling protraction and retraction of the writing tip by an actuating means installed in a top of the pen tube. Id.

While capless retractable writing instruments have a superior competitive advantage over a marker or pen having an outer cap, capless instruments have several problems. For example, the current sealing elements in retractable instruments are unreliable, as they often do not seal after prolonged use, time, or conditioning. Additionally, such seal assemblies are often unrepeatable, i.e., they do not provide a proper seal after every use. Additionally, "the assembling process is complicated, time-consuming," and difficult "to be sped up in mass production." See, e.g., the '812 patent, col. 2, lines 63-65 (explaining that "the conventional capless retractable marker pens still have many problems requiring solving").

The majority of attempts to solve these problems compromise one or both of the reliability and repeatability of the seal. More specifically, many current designs directly or indirectly rely on contact between an applicator element assembly, e.g., a nib assembly, and a valve door to force the valve door open from a closed state. However, such contact compromises the reliability of the valve seal in that wear results on both the applicator element and valve door. Additionally, because the applicator element typically deposits fluid upon contact, any interaction between the applicator element and the valve door results in fluid depositing on the sealing features of the valve door. Repeated interaction results in additional fluid depositing on the sealing features, thereby causing degradation of the seal quality to a point where the seal fails and exposes the applicator element to the ambient atmosphere. Build-up of fluid deposits due to continued contact between the applicator element and the valve door can further result in binding or sticking of the applicator element and the reservoir holder assembly during retraction.

More specifically, this fluid accumulation continues to the point where the forces generated by the viscosity of the fluid (or residual components of the fluid) prevent one or both of proper protraction and retraction of the applicator element and reservoir holder components. During retraction, fluid deposits may accumulate within and between an inner wall of a valve body and the outer wall of the tube in the applicator element assembly. During protraction, fluid previously deposited onto the valve door may also be transferred back onto an outer wall of a tube in the applicator element assembly. This transfer of fluid is possible because the valve door, which had contacted the applicator element, continues to remain in contact with the outer wall of the tube after the applicator element forces the door open.

Current designs also rely on a variety of either mechanical or material dependent means of providing a repeatable seal to the retractable instrument, e.g., marker. Each of these methods appears to provide varying degrees of repeatability of the seal. However, the repeatability of the seal designs that rely on the material elasticity to return back to a closed position all suffer from the effects of cycling and aging. For example, after prolonged use and exposure to a variety of conditions, the repeatability of the seal is compromised to a point where the applicator element is exposed to the ambient atmosphere. Designs that rely on mechanical means to provide a repeatable seal appear to provide a more repeatable seal for the retractable instrument; however, the complexity of such designs often results in mechanical failure. See, e.g., U.S. Pat. No. 5,022,773 (the '773 patent). The '773 patent discloses a design having a pliable steel member (24) with a spring clip (22) that provides a closure force for a seal member. This seal member design suffers from the same fluid, e.g., ink, accumulation problems previously described because the writing tip (34) itself forces the spring clip open while pushing through the seal member. Also, the writing tip is often damaged while protracting and retracting through the seal member because of the magnitude of the radial force generated by the spring clip.

SUMMARY OF THE DISCLOSURE

The present invention improves the reliability and repeatability of a closure assembly for a retractable instrument, e.g., a pen, marker, or the like. Specifically, a closure assembly is coupled to an internal instrument assembly, thereby allowing for constrained movement of the closure assembly when the instrument is protracted and retracted.

According to one aspect of the present disclosure, a closure assembly for a retractable instrument comprises at least two fingers and a movable sleeve operatively coupled with the at least two fingers. When the retractable instrument is in a retracted position, the sleeve constrains the fingers such that the fingers are in a fully closed state, thereby closing around the applicator element of the instrument. Protraction of the sleeve and relative movement between the fingers and the sleeve allows the fingers to open, thereby exposing the applicator element. The closure assembly may be coupled to an applicator element assembly, allowing the closure assembly and the applicator element assembly to be simultaneously protracted.

In one embodiment, the closure assembly may further include a base including a flange, such that the flange of the base engages an inner flange disposed on an inside surface of a tube of the retractable instrument.

The closure assembly may further comprise an end seal disposed on the assembly opposite the applicator element for sealing the base. Further, the sleeve of the closure assembly provides a seat for the fingers of the assembly in a retracted position.

Protraction of the fingers continues until a stop in the nose of the instrument engages a stop of the sleeve, thereby constraining the protraction of the fingers and simultaneously allowing the applicator element to completely protract out of the retractable instrument and into an application position. Further, during retraction of the applicator element, a set of stops disposed on the sleeve engages a set of stops disposed on a body of the instrument, thereby preventing further retraction and allowing the fingers to close around the applicator element.

The closure assembly may further comprise a collet or collet-type valve.

According to another aspect of the present disclosure, a retractable writing instrument comprises a body and a nose disposed at a first end of the body, and an internal writing assembly disposed within the body and including a nib. The retractable writing instrument further includes a closure assembly coupled to the internal writing assembly; the closure assembly comprises at least two fingers and a movable sleeve operatively coupled with the at least two fingers. When the retractable writing instrument is in a retracted position, the sleeve constrains the fingers such that the fingers are in a fully closed state, thereby closing around the nib. Protraction of the sleeve and relative movement between the fingers and the sleeve allows the fingers to open, thereby exposing the nib.

According to another aspect of the present disclosure, a retractable instrument comprises a body and a nose disposed at a first end of the body and an internal assembly disposed within the body and including an applicator element. The retractable instrument further comprises a closure assembly coupled to the internal assembly, wherein the closure assembly comprises at least two fingers and a movable sleeve operatively coupled with the at least two fingers. When the retractable instrument is in a retracted position, the sleeve constrains the fingers such that the fingers are in a fully closed state around the applicator element, and protraction of the sleeve and relative movement between the fingers and the sleeve allows the fingers to open, thereby exposing the applicator element.

BRIEF DESCRIPTION OF THE DRAWINGS

Objects, features, and advantages of the present disclosure will become apparent upon reading the following description in conjunction with one or more of the following figures.

DETAILED DESCRIPTION OF THE DISCLOSURE

Figure 1:
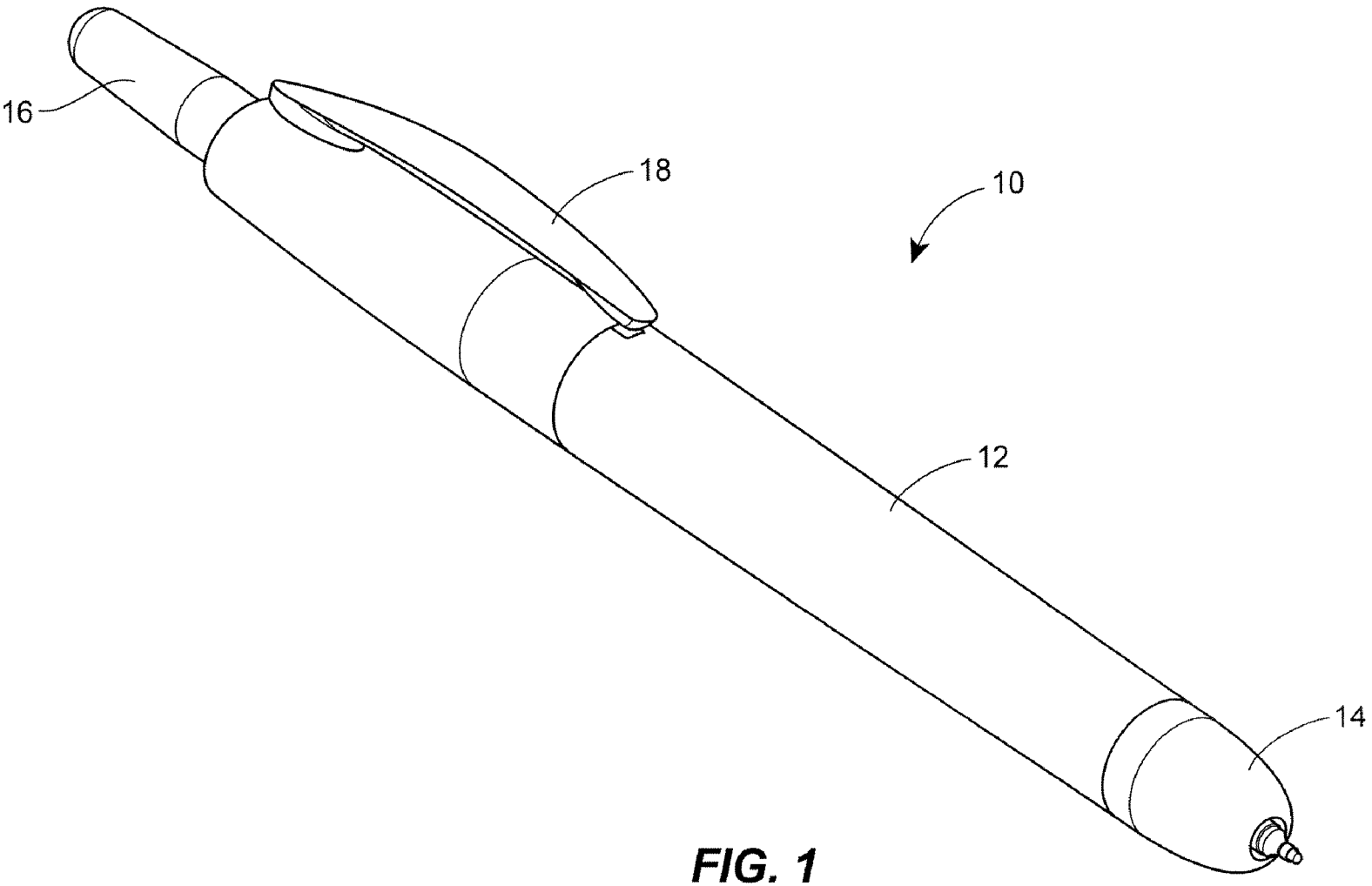
FIG. 1 is a perspective view of a capless retractable instrument in a protracted position having a seal assembly according to the present disclosure.

Referring now to FIG. 1, a retractable instrument 10 is shown. The retractable instrument 10 includes a body 12 and a nose 14, wherein the nose is disposed at a first end of the body 12. A push button or actuator 16 is disposed at a second or actuation end of the body 12, and a clip 18 is disposed on the body 12, as shown, for example, in FIG. 1. More specifically, a well-known knock-type actuation system may be employed that includes a plug having a shaft extending toward the actuation end, and a plunger disposed on the shaft. A spring is disposed between the plunger and the actuator or push button 16. When coupled together, the plug, plunger, spring and actuator or push button 16 provide the well known knock-type actuation system. As is known, by repeatedly pressing the actuator, the actuating system alternately places an applicator element, e.g., a nib, in a retracted position and a protracted or application position, e.g., a writing position. In addition to a knock-type actuation system, other types of actuation systems can be employed. For example, a side button actuation system as shown in U.S. Patent Publication No. 2006-0216103 A1, the disclosure of which is incorporated by reference, can also be used. In this example, the actuator of this disclosure has been replaced with a side actuator extending through a slot in the side wall of the body of the writing utensil or instrument.

Figure 2:
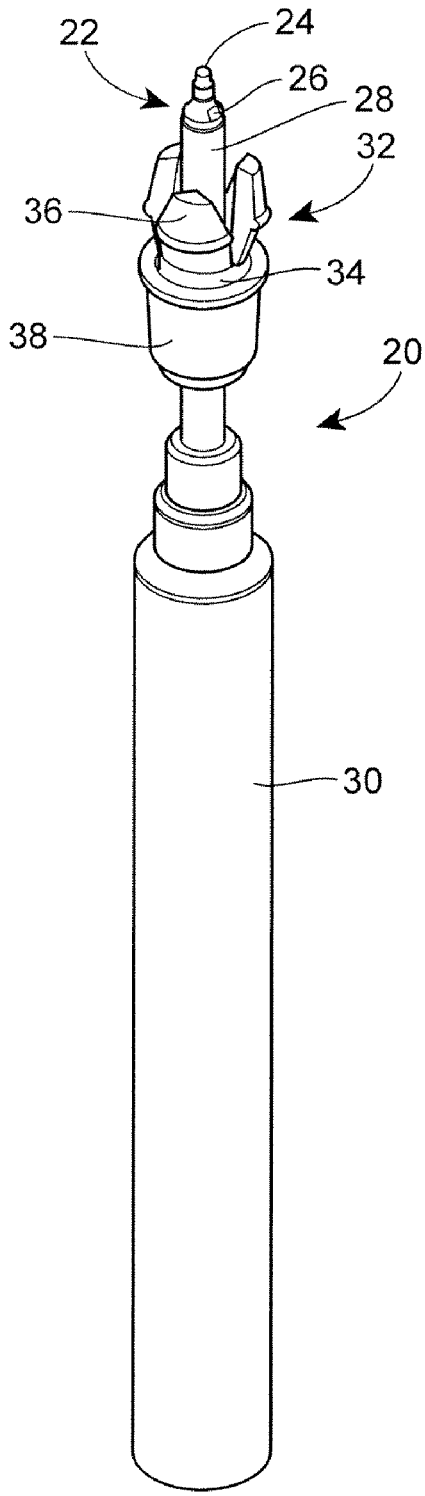
FIG. 2 is a front perspective view of the seal assembly of the present disclosure coupled to an internal instrument assembly.
Figure 3:
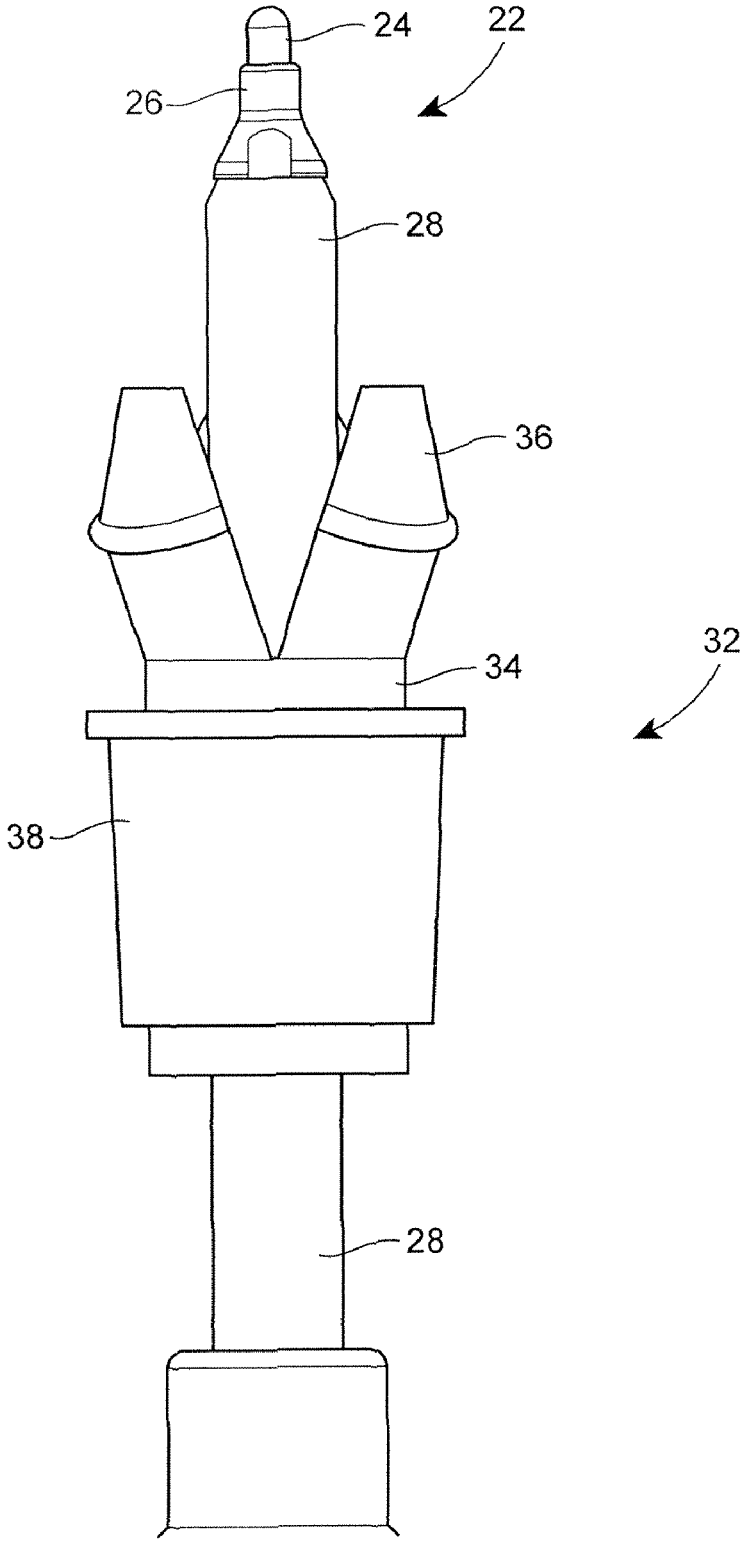
FIG. 3 is a front view of the seal assembly of the present disclosure in a protracted position.

Referring now to FIGS. 2 and 3, the retractable instrument 10 includes an internal instrument assembly 20 (FIG. 2). The internal instrument assembly 20 includes an applicator element assembly 22, which in this embodiment includes a nib 24 and a nib adapter 26, a tube 28, and a reservoir holder 30. A seal assembly 32 is coupled to the internal instrument assembly 20 and includes a base 34, fingers 36, and a sleeve 38. The body 12 houses both the applicator element assembly 22 and the seal assembly 32 when in a retracted position (see FIG. 5). Because the applicator element assembly 22 is linked to the seal assembly 32, the applicator element assembly 22 and the seal assembly 32 are simultaneously protracted and retracted.

Figure 4:
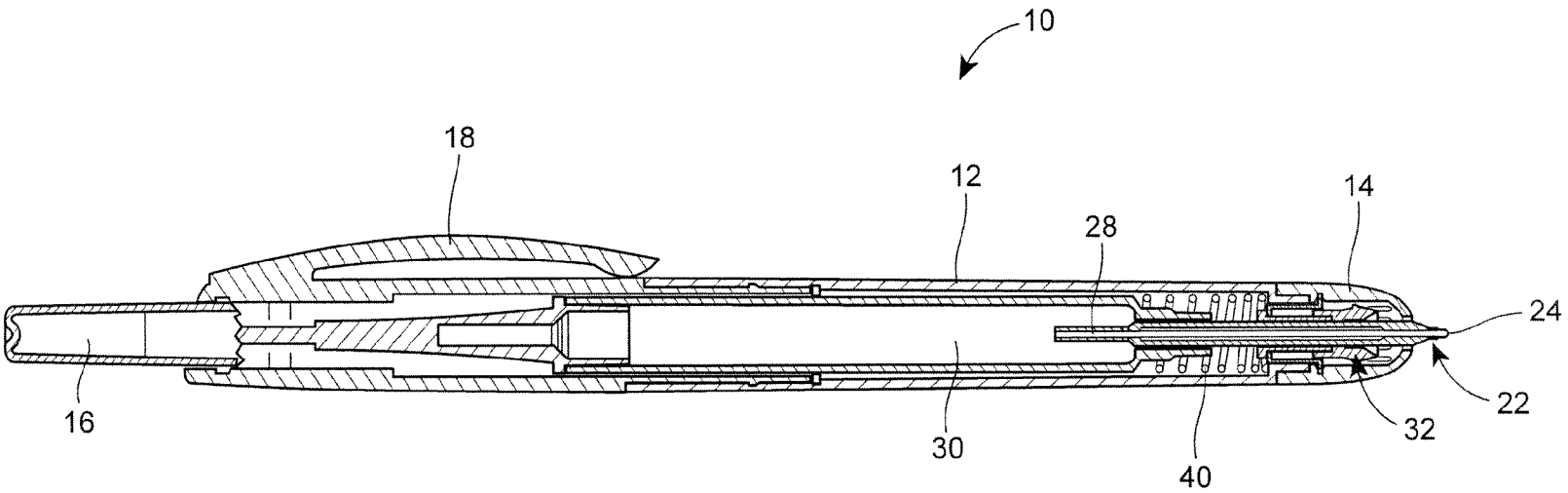
FIG. 4 is a cross-sectional view of the capless retractable instrument of FIG. 1 in a protracted position.

Referring now to FIG. 4, the internal components of the retractable instrument 10 are shown. The seal assembly 32 is coupled to the internal instrument assembly 20 (FIG. 2), e.g., the applicator element assembly 22, the tube 28, and the reservoir holder 30. The reservoir holder 30 provides means to store the fluid, e.g., ink, and the tube 28 holds the application element 24, e.g., the nib, and transfers the fluid from the reservoir holder 30 to the applicator element 24. A spring 40 is also shown. As is well know to those of skill in the art, the actuation of the push button 16 on the body 12 results in the directly linked protraction of the reservoir holder 30, the applicator element 24, the tube 28, and the applicator element adapter 26.

While a single embodiment of retractable instrument 10 is generally shown herein, the retractable instrument 10 can generally be constructed in any of the constructions shown in Brand et al., U.S. Pat. No. 6,964,534 (the '534 patent), the description of which is incorporated by reference. In other words, the seal assembly 32, as detailed below, can be incorporated into any of the writing utensil embodiments shown in the '534 patent with only minor modifications as would be seen by one of skill in the art. Accordingly, the seal assembly 32 can be used in combination with fibrous nibs that allow for fluid ink flow by capillaries formed in a porous reservoir, as is well understood by those of skill in the art. Additionally, the seal assembly 32 can be used in combination with a writing utensil designed as a free ink writing utensil, including those using a porous buffer system, wherein the reservoir is a volume in which the fluid ink is contained. Further, the seal assembly 32 can be used in combination with otherwise conventional ball point pens.

Figure 6:
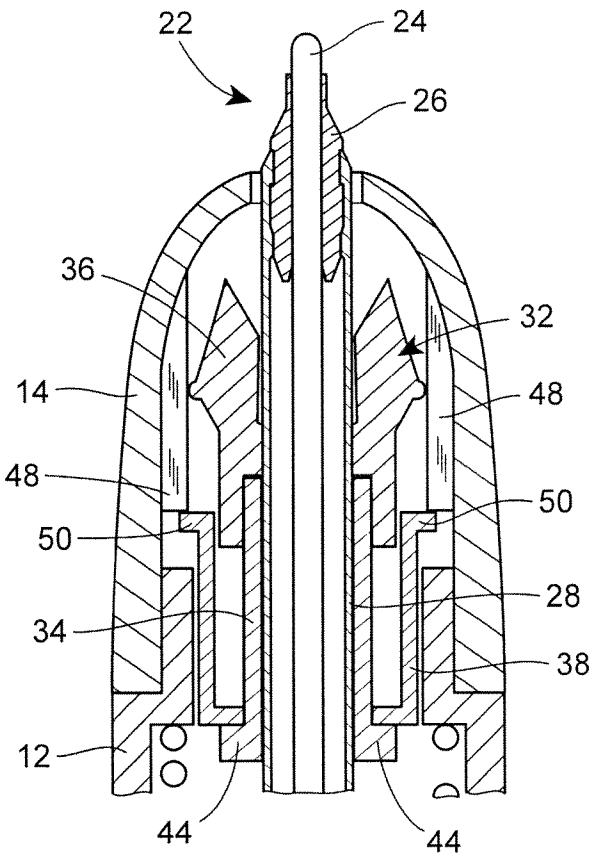
FIG. 6 is a cross-sectional view of the seal assembly of the present disclosure, wherein the partially shown retractable instrument is in a protracted position.
Figure 5:
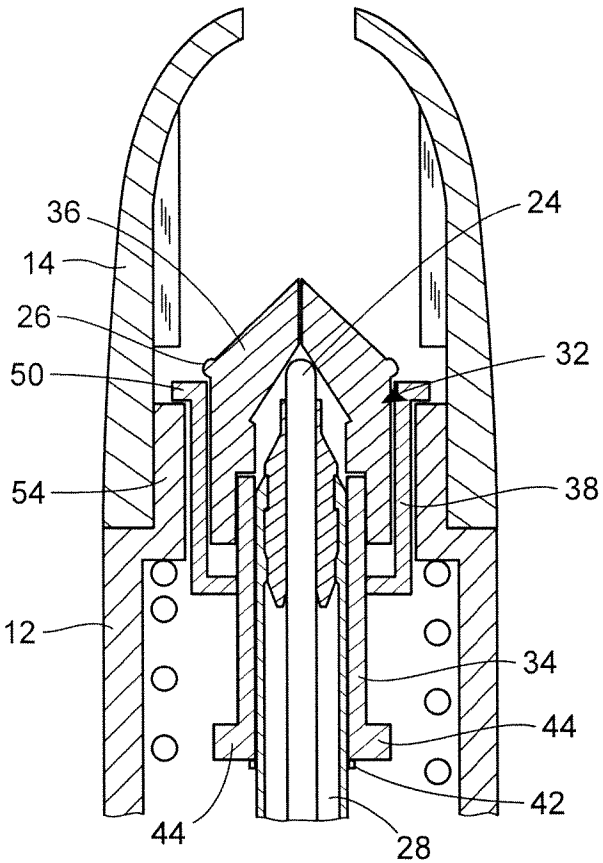
FIG. 5 is a cross-sectional view of the seal assembly of the present disclosure, wherein the partially shown retractable instrument is in a retracted position.

Referring to FIGS. 5 and 6, the base 34, fingers 36, and sleeve 38 of the seal assembly 32 are also incorporated into this protraction through the use of interference flange features incorporated on both the tube 28 and the base 34. More specifically, as shown in FIG. 5, the tube 28 includes a flange 42, and the base 34 also includes a flange 44. The interference flanges 42, 44 are engaged upon the initial protraction of the marker, as shown in FIG. 5.

The seal assembly 32 may also include an additional seal disposed at an end of the assembly opposite the applicator element 24 for sealing the back of the seal assembly 32 against the atmosphere. For example, the end seal may be provided by a seal bead disposed on one or both of an outer wall of the tube 28 and an inner wall of the base 34.

When in a retracted state, the sleeve 38 physically constrains the fingers 36 and also provides a seat. Specifically, interference between the inner wall of the sleeve 38 and the outer surface of the fingers 36 results in the fingers 36 being drawn upon each other to seal the applicator element 24 from the atmosphere.

When protraction begins, the seal assembly 32 is closed until the interference flange 44 of the base 34 contacts the sleeve 38 (FIG. 6) and the interference flanges 42, 44 on the tube 28 and base 34 are overcome. Then the fingers 36 of the seal assembly begin to open and protraction continues until a forward stop 48 on the nose 14 engages a corresponding forward stop 50 of the constrained sleeve 38, thereby constraining the protraction of the base 34 and fingers 36. At this point, the fingers 36 are opened, allowing the applicator element 24, e.g., the nib, to completely protract out of the nose 14 and into an application position. During this process, none of the sealing features of the seal assembly 32 contacts the applicator element 24 to transfer fluid from the applicator element 24, thereby eliminating potential degradation of the seal.

To retract the applicator element 24 back into the body 12, the interference flange 44 on the base and the interference flange 42 of the tube 28 engage, which is caused by a retraction force of the actuation mechanism, e.g., force or pull of the spring. Recall that while the interference flange 44 on the base and the interference flange 42 of the tube 28 are engaged when the applicator element 24 is in a fully retracted position (see, e.g., FIG. 5) the interference flange 42 of the tube 28 overcomes the interference flange 44 of the base during protraction (see, e.g., FIG. 6). Thus, the interference flange 42 of the tube 28 is disposed within or just adjacent to the fingers 36 of the seal assembly 32 (FIG. 6) when the applicator element 24 is in a fully protracted position. As such, when retraction begins the applicator element assembly 22 begins to move back into the body 12 and retraction continues until the stops 50 of the sleeve 38 engage the stops 54 on the body 12 (see FIG. 5), such that the fingers 36 finish closing around the applicator element 24. In other words, the fingers 36 are drawn tightly against each other to form a reliable and repeatable seal. Additionally, when the stops 50 engage the stops 54, the flanges 42, 44 engage and are positioned for the next protraction cycle.

With this design assembly, the seal assembly 32 reliably and consistently seals the applicator element 24 of the instrument from the external environment to prevent dry-out of the applicator element 24 of the writing instrument. Moreover, unlike the current hand-assembly methods of the valve assemblies now used, for example, for markers and the like, the assembly methods for the seal assembly 32 of the retractable instrument 10 described above may be incorporated into a high-speed assembly process without the need for a significant amount of hand-assembly work.

Figure 7:
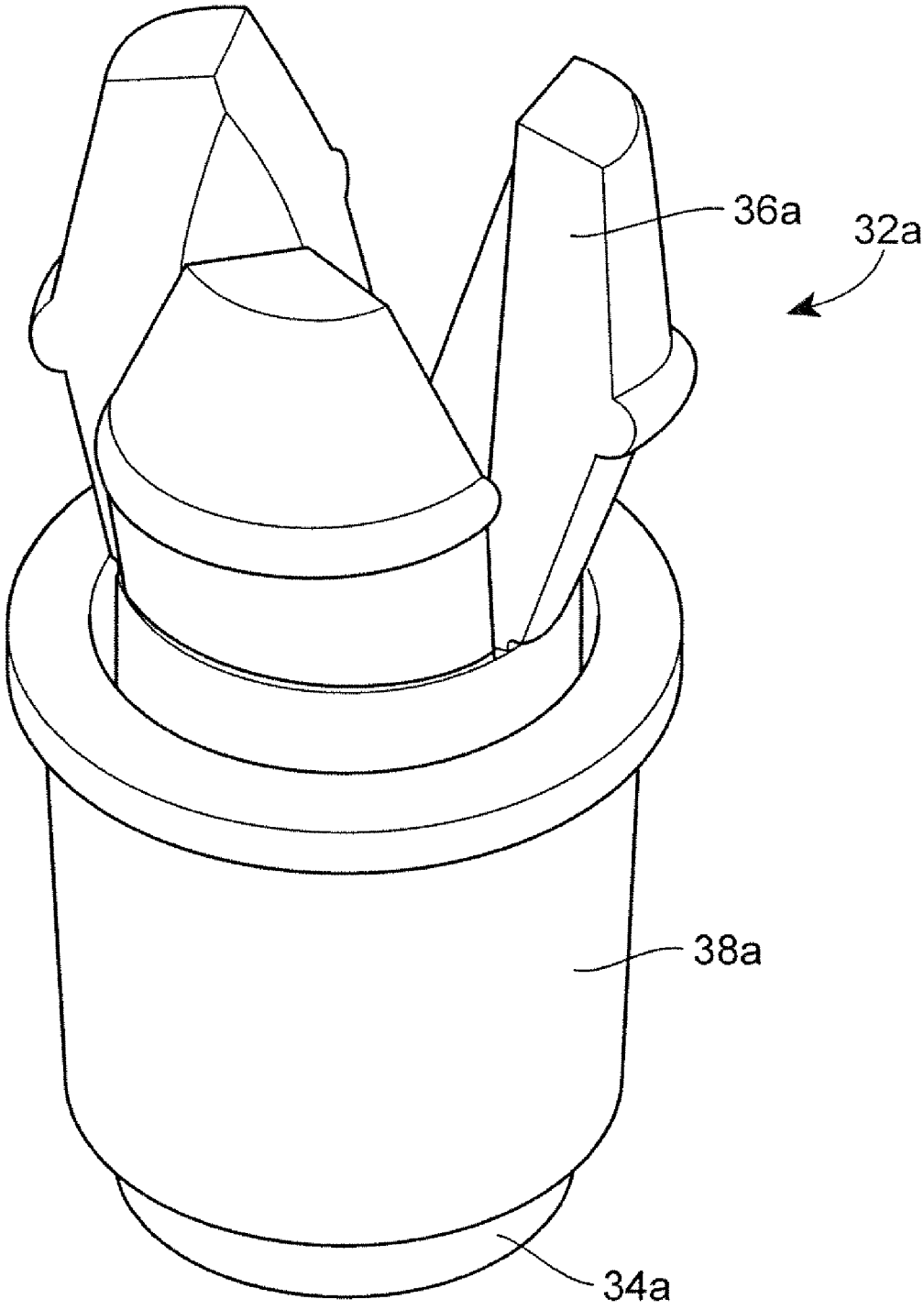
FIG. 7 is a perspective view of the seal assembly of the present disclosure, wherein fingers of the seal assembly are in an open position.
Figure 8:
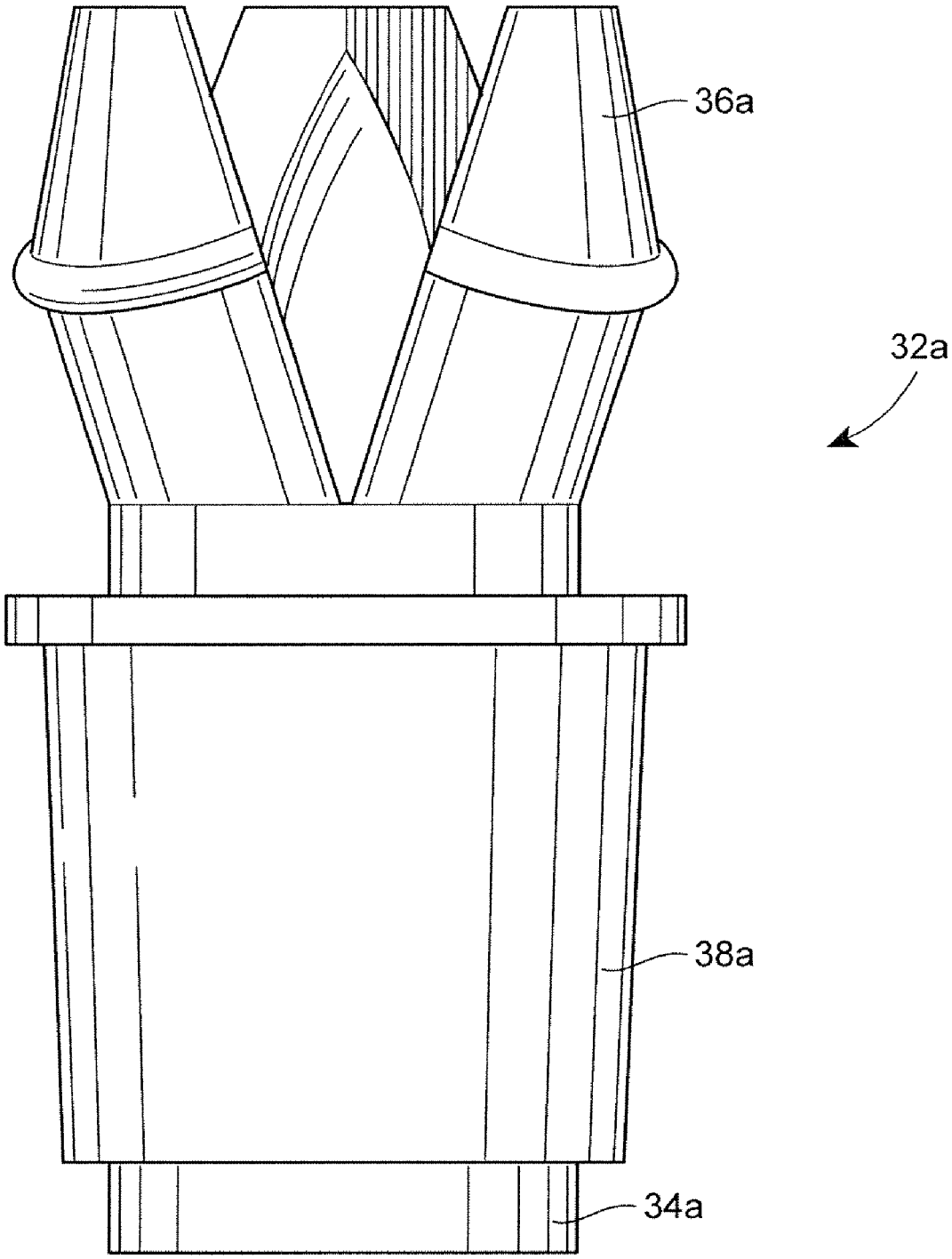
FIG. 8 is a front view of the seal assembly of the present disclosure, wherein fingers of the seal assembly are in an open position.

The seal assembly 32 may be a collet or collet-type valve assembly, as shown, for example, in FIGS. 7 and 8. For example, the collet-type valve assembly **32*a* includes a base 34*a*, fingers 36*a* and a sleeve 38*a***.

Further, the sealing features of the seal assembly 32, such as the fingers 36, may be formed of a variety of materials, such as thermoplastic elastomers, which are also known as TPEs. A thermoplastic elastomer is a material which is both a thermoplastic, i.e., it can be melted and cooled to the same state and an elastomer, i.e., rubbery. Most elastomers are thermosets; in contrast, thermoplastic elastomers are relatively easy to use in manufacturing, for example, by injection molding. Because they can be melted and reused, thermoplastic elastomers have the potential to be recycled, unlike thermosets. See http://en.wikipedia.org/wiki/Thermoplastic elastomer; see also http://www.pslc.ws/mactest/tpe.htm. TPEs include thermoplastic urethanes, which are also known as TPUs. Various TPE products, such as Santoprene® products, may be found at Advanced Elastomer Systems, L.P., in Akron, Ohio, for example.

Other molded parts of the seal assembly 32 and retractable instrument 10 may be formed from thermoplastic polymers. As used herein, thermoplastic polymers generally include synthetic high polymers that soften when exposed to heat and return to their original state when cooled to room temperature. More specifically, thermoplastic polymers include polyvinyl chlorides, nylons, propylene/α-olefin copolymers, polyethylenes, ethylene/α-olefin copolymers, polyurethane prepolymers, polystyrenes such as styrene/ethylene and hydrogenated styrene/butadiene block copolymers, polypropylenes, cellulosic resins, and acrylic resins.

Although certain capless retractable instruments have been described herein in accordance with the teachings of the present disclosure, the scope of coverage of this patent is not limited thereto. On the contrary, this patent covers all embodiments of the teachings of the disclosure that fairly fall within the scope of permissible equivalents. Additionally, as will be appreciated by one of skill in the art, retractable instruments having the seal assembly 32 described above may be used in writing instruments such as highlighters, markers, felt-tipped pens, ball point pens, and the like. In addition to writing instruments, the seal assembly 32 is also applicable to a variety of other retractable instruments including paint brush applicators, correction fluid applicators, make-up applicators, such as nail polish and mascara applicators, perfume applicators, and deodorant applicators.

We claim:

1. A closure assembly for a retractable instrument having an applicator element, the closure assembly comprising:

at least two fingers; and a movable sleeve operatively coupled with the at least two fingers;

wherein, when the retractable instrument is in a retracted position, the movable sleeve constrains the fingers such that the fingers are in a fully closed state around the applicator element, and protraction of the movable sleeve and relative movement between the fingers and the sleeve allows the applicator element to be exposed.

2. The closure assembly of claim 1, wherein the closure assembly is linked to a applicator element assembly of the retractable instrument allowing the closure assembly and applicator element assembly to be simultaneously protracted.

3. The closure assembly of claim 1, further comprising a base attached to the at least two fingers, wherein the base comprises a flange.

4. The closure assembly of claim 3, wherein, in the retracted position, the flange of the base engages a flange disposed on a tube of the retractable instrument.

5. The closure assembly of claim 3, further comprising an end seal disposed on the closure assembly opposite the applicator element for sealing the base.

6. The closure assembly of claim 1, wherein the sleeve provides a seat for the fingers in the retracted position.

7. The closure assembly of claim 1, wherein, during retraction of the applicator element, a set of stops disposed on the sleeve engages a set of stops disposed on a body of the instrument, thereby allowing the fingers to close around the applicator element.

8. The closure assembly of claim 1, wherein the closure assembly is one of a collet valve or collet-type valve assembly.

9. The closure assembly of claim 1, wherein the retractable instrument is one of a writing instrument, a paint brush applicator, a correction fluid applicator, a make-up applicator, a perfume applicator, and a deodorant applicator.

10. The closure assembly of claim 9, wherein the writing instrument is one of a highlighter, a marker, a felt-tipped pen, and a ball point pen.

11. The closure assembly of claim 9, wherein the make-up applicator is one of a nail polish or a mascara applicator.

12. A retractable writing instrument comprising:

a body and a nose disposed at a first end of the body;

an internal writing assembly disposed within the body and including a nib; and a closure assembly coupled to the internal writing assembly, the closure assembly comprising at least two fingers and a movable sleeve operatively coupled with the at least two fingers;

wherein, when the retractable writing instrument is in a retracted position, the movable sleeve constrains the fingers, such that the fingers are in a fully closed state around the nib, and protraction of the movable sleeve and relative movement between the fingers and the sleeve allows the fingers to open, thereby exposing the nib.

13. The retractable writing instrument of claim 12, wherein the internal writing assembly further comprises a nib adapter, a reservoir holder for retaining ink, and a tube for transferring ink from the reservoir holder to the nib.

14. The retractable writing instrument of claim 13, further comprising a base attached to the at least two fingers, wherein the base comprises a flange, and the tube comprises a flange, such that the base flange and the tube flange are engaged in the retracted position.

15. The retractable writing instrument of claim 12, wherein the closure assembly further comprises an end seal disposed on the assembly opposite the nib for sealing the base.

16. The retractable writing instrument of claim 12, wherein, during retraction of the nib, a set of stops disposed on the sleeve engage a set of stops disposed on the body, thereby allowing the fingers to close around the nib.

17. The retractable writing instrument of claim 12, wherein the closure assembly is one of a collet or collet-type valve assembly.

18. A retractable instrument comprising:

a body and a nose disposed at a first end of the body;

an internal assembly disposed within the body and including an applicator element; and a closure assembly coupled to the internal assembly, the closure assembly comprising at least two fingers and a movable sleeve operatively coupled with the at least two fingers;

wherein, when the retractable instrument is in a retracted position, the movable sleeve constrains the fingers such that the fingers are in a fully closed state around the applicator element, and protraction of the movable sleeve and relative movement between the fingers and the sleeve allows the fingers to open, thereby exposing the applicator element.

19. A closure assembly for a retractable instrument having an applicator element, the closure assembly comprising:

at least two fingers; and a sleeve operatively coupled with the at least two fingers;

wherein, when the retractable instrument is in a retracted position, the sleeve constrains the fingers such that the fingers are in a fully closed state around the applicator element, and protraction of sleeve and relative movement between the fingers and the sleeve allows the fingers to open, thereby exposing the applicator element, and wherein protraction of the fingers continues until a stop of a nose of the instrument engages a stop of the sleeve, thereby constraining the protraction of the fingers and allowing the applicator element to completely protract out of the retractable instrument and into an application position.

20. A retractable writing instrument comprising:

a body and a nose disposed at a first end of the body;

an internal writing assembly disposed within the body and including a nib; and a closure assembly coupled to the internal writing assembly, the closure assembly comprising at least two fingers and a sleeve operatively coupled with the at least two fingers;

wherein, when the retractable writing instrument is in a retracted position, the sleeve constrains the fingers, such that the fingers are in a fully closed state around the nib, and protraction of the sleeve and relative movement between the fingers and the sleeve allows the fingers to open, thereby exposing the nib, and wherein protraction of the fingers continues until a forward stop of the nose engages a forward stop of the sleeve, thereby constraining the protraction of the fingers and allowing the nib to completely protract out of the body and into a writing position.

* * * * *